US007339142B2

(12) United States Patent
Pessayre et al.

(10) Patent No.: US 7,339,142 B2
(45) Date of Patent: Mar. 4, 2008

(54) HEATING DEVICE COATED WITH A SELF-CLEANING COATING

(75) Inventors: Stéphanie Pessayre, Corbas (FR); Henry Boulud, Diemoz (FR)

(73) Assignee: SEB S.A., Ecully (FR)

( * ) Notice: Subject to any disclaimer, the term of this patent is extended or adjusted under 35 U.S.C. 154(b) by 438 days.

(21) Appl. No.: 10/536,050

(22) PCT Filed: Nov. 20, 2003

(86) PCT No.: PCT/FR03/03429

§ 371 (c)(1),
(2), (4) Date: May 23, 2005

(87) PCT Pub. No.: WO2004/061371

PCT Pub. Date: Jul. 22, 2004

(65) Prior Publication Data

US 2006/0151474 A1 Jul. 13, 2006

(30) Foreign Application Priority Data

Dec. 5, 2002 (FR) ..... 02 15360

(51) Int. Cl.
*H05B 3/16* (2006.01)
*B01J 33/00* (2006.01)

(52) U.S. Cl. ..... 219/543; 219/521; 502/249; 502/60; 502/66; 502/74; 502/84; 502/241; 502/244; 427/453; 427/455; 427/330; 428/450

(58) Field of Classification Search ..... 38/93; 427/453, 455, 330; 428/450; 126/19 R; 502/2, 60, 66, 74, 84, 241, 244, 249; 219/521, 219/543
See application file for complete search history.

(56) References Cited

U.S. PATENT DOCUMENTS

| | | | |
|---|---|---|---|
| 3,566,855 | A | 3/1971 | Morgan |
| 4,029,603 | A | 6/1977 | Denny et al. |
| 4,180,482 | A | 12/1979 | Nishino et al. |
| 4,862,609 | A | 9/1989 | Ullrich et al. |

FOREIGN PATENT DOCUMENTS

| | | |
|---|---|---|
| FR | 2 400 876 | 3/1979 |

*Primary Examiner*—Shawntina Fuqua
(74) *Attorney, Agent, or Firm*—Browby and Neimark, PLLC

(57) ABSTRACT

The invention relates to a heating device (1) comprising a metallic substrate (2) whose at least one part is coated with a self-cleaning coating. The inventive coating consists of an external layer (4) contacting ambient air and comprising at least one type of oxidation catalyst selected from platinoid oxides, at least one internal layer (3) which is arranged between the metallic substrate and the external layer and comprises at least one type of oxidation catalyst selected from transition elements oxides of 1b group. The inventive heating device can be embodied, for instance in the form of an iron soleplate consisting of a heating base (6) provided with heating elements (7) or a cooking appliance. Said metallic substrate can be covered with an intermediary enamel layer (5). A method for coating the metallic substrate of a heating device with said coating is also disclosed.

12 Claims, 1 Drawing Sheet

HEATING DEVICE COATED WITH A SELF-CLEANING COATING

Figure 1:
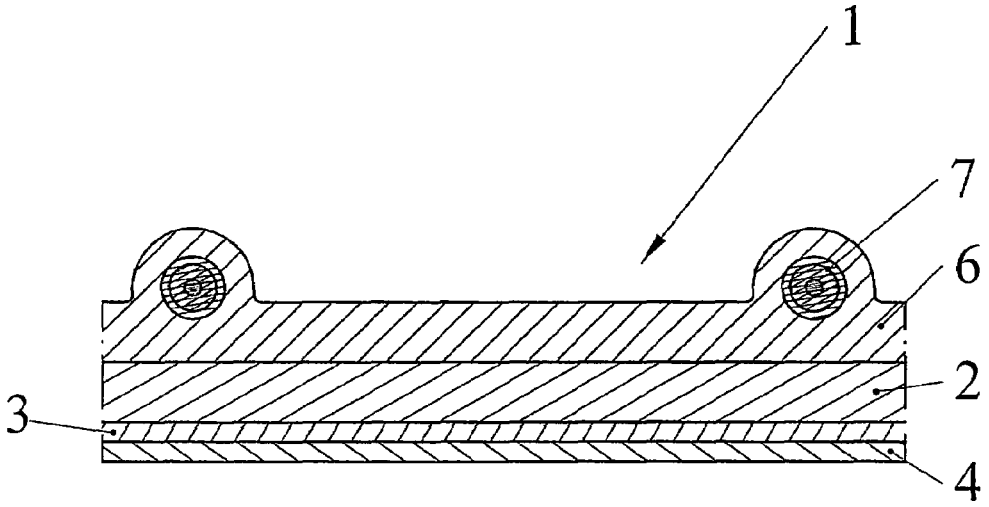

The present invention relates to heating devices or devices intended to be heated during their use and comprising a self-cleaning coating.

Certain heating devices, such as for example pressing iron soleplates or cooking devices, have qualities of ease of use and effectiveness, dependent inter alia on the state and nature on surface on their coating.

Pressing iron soleplates have been able to be improved by the attention given to the sliding qualities of the ironing surface, combined with qualities allowing easier spreading out of the linen. A way of obtaining these qualities is to resort to soleplates enamelled with an enamel of smooth aspect, with possibly lines of extra thickness making it possible to spread out the fabric during the displacement of the iron. Other metal soleplates treated mechanically and/or covered or not with a deposit to facilitate sliding can also be appropriate for a satisfactory use.

However, with use, the soleplate can tarnish by carbonizing in a more or less diffuse way on its ironing surface, and in a more or less incomplete way, the various organic particles collected by friction on ironed fabrics.

But when the soleplate is tarnished, even in a manner that is not very visible, it partially loses its sliding qualities. Imperceptibly, with the fouling, ironing becomes more difficult. In addition, the user is reluctant to use a tarnished iron, fearing that it can deteriorate their linen.

Pressing iron soleplate coatings are known having a hard and resistant layer covered, as indicated by the patent U.S. Pat. No. 4,862,609, by a layer improving the surface properties. But this patent does not indicate a solution to deal with fouling.

The walls of the cooking devices are also often covered with an enamelled layer of smooth aspect so that possible projections of grease or food do not adhere to surface. Enamelled self-cleaning surfaces are known, for example in ovens and cooking utensils as described for example in patent U.S. Pat. No. 4,029,603 or patent FR2400876.

However, these coatings does not give complete satisfaction with regard to their self-cleaning properties.

There thus exists the need for a coating for a heating device like cooking devices or pressing iron soleplates, which maintains the covered surface clear of any contamination by organic particles, and is not fouled in normal use, in order to preserve its initial qualities.

The present invention relates to a heating device comprising a metal support of which at least a part is covered with a self-cleaning coating, characterized in that the coating comprises:

a°) an external layer, in contact with the ambient air, comprising at least one oxidation catalyst chosen among oxides of platinoids, b°) at least one internal layer, located between the metal support and the external layer, comprising at least one oxidation catalyst chosen among the oxides of the transition elements of Group 1*b*.

The present invention also has as an aim a process for covering the metal support of a heating device with a self-cleaning coating such as above, characterized in that it comprises the following steps:

i) one heats the surface of the metal support to be covered in an oven at around 400° C., ii) one places the surface of the metal support to be covered under infra-red at a temperature of 400° C. to 600° C. for a few seconds, iii) one sprays a solution of an oxidation catalyst precursor chosen among oxides of the transition elements of Group 1*b* on the surface of the metal support to be covered to obtain the internal layer, iv) one again heats the surface of the metal support to be covered, with the internal layer, in an oven at around 400° C., v) one places the surface of the metal support to be covered, with the internal layer, under infra-red at a temperature of 400° C. to 600° C. for a few seconds, vi) one sprays a solution of an oxidation catalyst precursor chosen among oxides of platinoids on the internal layer to obtain the external layer, vii) one reheats the surface of the metal support covered with the internal and external layers under infra-red for a few minutes.

Owing to the invention, one obtains a device whose self-cleaning coating presents a particularly excellent catalytic activity and whose adherence to the metal support is very good.

It was in effect noted that the association of an oxidation catalyst chosen among oxides of the transition elements of Group 1*b* in the internal layer with an oxidation catalyst chosen among oxides of platinoids in the external layer increased in operation the self-cleaning activity of the coating in a synergistic way.

Owing to the invention, the organic particles in contact with the external layer of the coating are oxidized when the device is heated. In addition, the effect of synergy obtained by the particular association of an internal layer comprising a specific oxidation catalyst and of an external layer comprising a specific oxidation catalyst different from that of the internal layer makes it possible to obtain a coating presenting a particularly powerful catalytic activity. Thus, the surface of the coating is restored very quickly.

For example, during ironing with a pressing iron, the organic particles collected by the soleplate are oxidized. They are to some extent burned when the pressing iron is hot, the possible solid residue loses any adherence and is detached from the soleplate. The soleplate is maintained clean.

Similarly, in a cooking device such as an oven for example, projections of grease present on the wall of the oven are oxidized while hot, the solid residue is detached from the wall, which is maintained clean.

Moreover, owing to the process of the invention and in particular owing to the exposure of the surface of the metal support to be covered to the infrared, the adherence of the coating to the metal support is particularly good. This improved adherence makes it possible to increase the friction resistance of the coating, this property being particularly advantageous in the case of a pressing iron soleplate for example.

By "heating device", one understands within the meaning of the present request, any device, article or utensil, which during its operation reaches a temperature at least equal to 45° C., and preferably at least equal to 90° C. The device can reach this operating temperature by means which are specific to it, as for example a heating base integrated into the device and provided with heating elements, or by external means. Such devices are for example pressing iron soleplates, cooking devices, ovens, grills, kitchen utensils.

The external coating layer according to the invention comprises an oxidation catalyst chosen among oxides of platinoids. By "platinoids", one understands, within the meaning of the present request, the elements having properties similar to those of platinum, and in particular, in addition to platinum, ruthenium, rhodium, palladium, osmium and iridium. Preferably, the external layer comprises an oxidation catalyst chosen among palladium oxides, platinum oxides and their mixtures.

In practice, such oxidation catalysts are well-known in themselves, as well as their fabrication processes, without it being necessary to describe in detail their methods of preparation respectively. Thus, as an example, as regards platinum as an oxidation catalyst, its catalytically active form can be obtained by calcination or decomposition of a chloroplatinic acid salt or any other precursor.

Of course any oxidation catalyst used according to the present invention will have to remain sufficiently stable at the operating temperature of the device, and this within the limits of the useful lifespan of the device.

The surface of the external layer is directly in contact with the ambient air and the organic stains. By "organic stains", one understands within the meaning of the present application any substance combustible or oxidizable, completely or partially, in contact with the ambient air. As an example, one can cite any synthetic fiber residue, as used in textile articles, for example of organic polymer such as polyamide or polyester, any organic residue of a washing product and possibly of a softening product, any organic substance such as projections of greases or foods.

The oxidation catalyst chosen among oxides of platinoids is distributed on and/or in the external coating layer, where it is in contact with the stains, and over whole or part of the external layer, in a continuous or discontinuous way.

In the case of a pressing iron soleplate which comprises or not relief zones, the oxidation catalyst chosen among the platinoids is distributed on the external surface of the soleplate, intended to be put in contact with the linen.

The coating can comprise, in addition to the oxidation catalyst chosen among oxides of platinoids, any other internal support layer that is catalytically inert with regard to oxidation. This support adherent to the metal support and catalytically inert is preferably selected among the compounds of aluminum or silicon, such as for example alumina in divided form or in particles, enamel, polytetrafluoroethylene and their mixtures.

In a preferred embodiment of the invention, the support that is catalytically inert with regard to oxidation is an enamel with low porosity and/or roughness, on a micrometric and/or nanometric scale. The enamel is for example a vitrified enamel. The enamel should preferably be hard, slide easily and resist the penetration of hot steam or moisture.

The external layer of the coating preferably has a thickness, measured according to the RBS method described in Example 1 of the present application, extending from 10 nanometers to 500 nanometers, and preferably still extending from 20 nanometers to 120 nanometers.

The oxidation catalyst of the external layer being active at a coating temperature greater than or equal to 90° C., it cleans said coating when the latter is heated at least to such a temperature.

The internal layer comprises at least one oxidation catalyst chosen among oxides of the transition elements of Group 1*b*, preferably selected among copper oxides, silver oxides and their mixtures.

In practice, such oxidation catalysts are well-known per se, as well as their production processes, without it being necessary to describe in detail their methods of preparation respectively. As an example, concerning silver oxide as an oxidation catalyst, one can use as a precursor silver nitrate sold commercially by the Aldrich company.

Preferably, the catalytically active internal layer has a thickness, measured according to the RBS method described in Example 1 of the present application, extending from 20 nanometers to 50 nanometers.

Preferably, the oxidation catalyst present in the internal layer has a good affinity with the oxidation catalyst present in the external layer. In effect, after application on the support of the internal and external layers, the support is reheated and, during this step, the oxidation catalyst present in the internal layer can diffuse into the external layer and the oxidation catalyst present in the external layer can diffuse into the internal layer. In a preferred embodiment of the invention, the external layer comprises as oxidation catalyst an oxide of palladium and the internal layer comprises as oxidation catalyst a silver oxide. In a more preferred embodiment of the invention, the silver oxide has diffused into the external layer and the external layer thus comprises a mixture of palladium oxide and silver oxide. There was observed a particular synergy effect at the level of the catalytic activity of the coating in such an embodiment of the invention.

In a preferred embodiment of the invention, the heating device is in the shape of a pressing iron soleplate comprising an ironing surface and coating covers the ironing surface.

In another preferred embodiment of the invention, the heating device is a cooking device comprising walls likely to come in contact with organic stains and coating covers these walls.

In a first operating mode, the catalyst acts at the operating temperature of the device and the coating is kept clean as the device is being used.

In a second operating mode, at the time of a phase termed self-cleaning, before or after use of the device, the latter is adjusted to a high temperature, equal to or higher than the highest operating temperatures, it is then left on standby during a predetermined time, during which the oxidation catalyst takes effect. The user can thus regularly maintain his device, without awaiting a harmful soiling.

The metal support of the device according to the invention can be based on any metal usually employed in the field of the heating devices like aluminum, steel or even titanium. This metal support can itself be covered with a protective layer as for example an enamelled layer before being covered by the coating of the present invention. Thus, in a preferred embodiment of the invention, the device comprises an enamel intermediate layer located between the metal support and the catalytically active internal layer of the coating.

The application of catalytically active internal and external layers on the metal support, covered or not by an enamelled layer, is done preferably by pyrolysis, by heating of the surface to be covered then spraying on this hot surface of a solution containing a precursor of the oxidation catalyst. By "precursor", one understands any chemical or physicochemical form of oxidation catalyst, which is likely to lead to, or to liberate this latter by any appropriate treatment, for example pyrolysis.

In an embodiment of the process according to the invention, the surface of the metal support to be covered is heated in an oven to around 400° C. then placed very briefly, for example during a few seconds, under infra-red, until reaching a surface temperature that can go from 400° C. to 600° C. This operation softens the surface of the support and makes it possible to increase the later adherence of the coating. A solution of the oxidation catalyst precursor chosen among the transition elements of Group 1*b* is sprayed onto the surface of the metal support. On contact with the surface, the precursor oxidizes and is fixed on the support and water evaporates. A layer with a thickness extending from 20 to 50 Nm is deposited. The support cools very quickly. It is heated again by in the oven to 400° C. then under infra-red to a temperature which can extend from 400° C. to 600° C. during a few seconds. A solution of the oxidation catalyst precursor chosen among the platinoids is sprayed over the internal layer. A layer of a thickness extending from 20 to 50 Nm is deposited. The support thus covered is then reheated under infra-red during a few minutes, for example during five minutes.

One obtains a support covered with a coating whose self-cleaning properties are particularly good.

The invention will be better understood by reading the examples hereafter and the annexed drawings.

Figure 2:
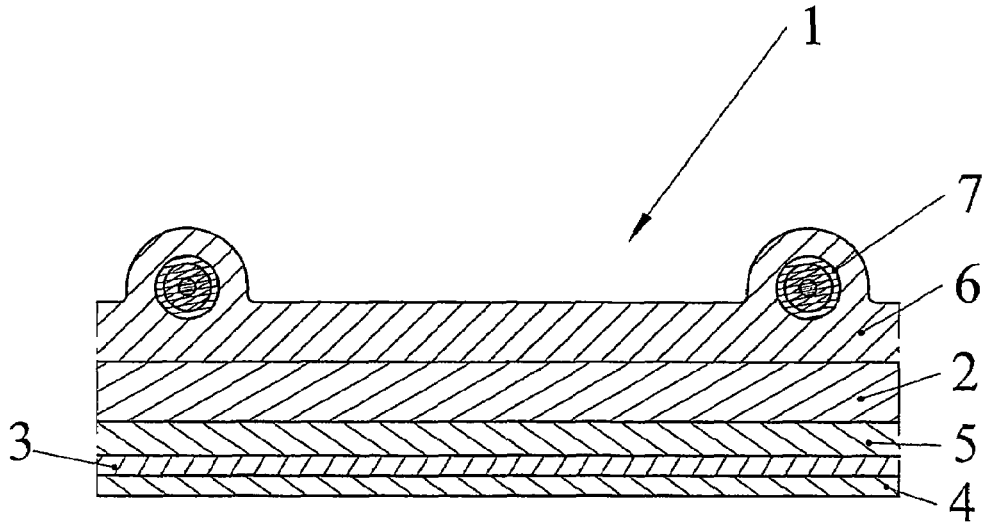

FIG. 1 is a cross-sectional view of a pressing iron soleplate according to the invention, FIG. 2 is a cross-sectional view of a soleplate of pressing iron according to the invention comprising an enamelled protective coating.

Referring to FIG. 1, there is shown in cross section a heating device 1 in the shape of a pressing iron soleplate comprising a metal support 2 covered with an internal layer 3 and an external layer 4. The soleplate also comprises a heating base 6 provided with heating elements 7. Support 2 and base 6 are assembled by mechanical means or by gluing. Internal layer 3 comprises an oxidation catalyst chosen among oxides of the transition elements of Group 1*b* and external layer 4 comprises an oxidation catalyst chosen among oxides of platinoids.

Referring to FIG. 2, there is shown in cross section a pressing iron soleplate comprising a metal support 2 covered with an intermediate layer 5, an internal layer 3 and an external layer 4. The soleplate also comprises a heating base 6 provided with heating elements 7, glued onto support 2. Internal layer 3 comprises an oxidation catalyst chosen among oxides of the transition elements of Group 1*b* and external layer 4 comprises an oxidation catalyst chosen among oxides of platinoids. Protective layer 5 is of enamel.

EXAMPLE 1

A clean pressing iron soleplate of enamelled aluminum is placed on an aluminum support of approximately 2 cm to store heat as well as possible. The unit is heated to 400° C. in an oven. The soleplate, with the support, is placed during a few seconds under infra-red until reaching a surface temperature between 400° C. and 600° C. Silver nitrate, sold by the Aldrich company, is placed in solution in water at 4 g/l and is sprayed by means of an air gun onto the soleplate. A layer of around 40 to 50 Nm, measured according to RBS method, is deposited. The RBS (Rutherford Backscattering Spectroscopy) method is a technique of analysis based on the elastic interaction between a beam of $^{4}He^{2+}$ ions and the component particles of the sample. The high energy (2 MeV) beam strikes the sample, the retrodiffused ions are detected at an angle teta. The spectrum thus acquired represents the intensity of the ions detected according to their energy and makes it possible to determine the thickness of the layer. This method is described in W. K. Chu and G. Langouche, MRS Bulletin, Jan. 1993, p 32.

After the application of this internal layer, the soleplate is heated in the oven to 400° C. then placed again during a few seconds under infra-red to a temperature between 400° C. and 600° C. An aqueous solution of palladium nitrate stabilized by nitric acid, sold by the Metalor company, is sprayed by means of a gun pneumatically on the soleplate. A layer of around 40 to 50 Nm, measured according to RBS method described above, is deposited.

After the application of this external layer, the unit is reheated under infra-red to 500° C. during three minutes.

One obtains a pressing iron soleplate whose self-cleaning coating adheres particularly well to the soleplate and has a very good catalytic activity and preserves its sliding qualities.

The invention claimed is:

1. Heating device (1) comprising a metal support (2) of which at least a part is covered with a self-cleaning coating, characterized in that the coating comprises:

a°) an external layer (4), in contact with the ambient air, comprising at least one oxidation catalyst chosen among the oxides of platinoids, b°) at least one internal layer (3), located between the metal support (2) and the external layer (4), comprising at least one oxidation catalyst chosen among oxides of the transition elements of Group 1*b*.

2. Device according to claim 1, characterized in that the oxidation catalyst of the external layer (4) is selected among palladium oxides, platinum oxides and their mixtures.

3. Device according to claim 1, characterized in that the oxidation catalyst of the internal layer (3) is selected among copper oxides, silver oxides and their mixtures.

4. Device according to claim 1, characterized in that the external layer (4) comprises as oxidation catalyst a palladium oxide and the internal layer (3) comprises as oxidation catalyst a silver oxide.

5. Device according to claim 4, characterized in that the external layer comprises a mixture of palladium oxide and silver oxide.

6. Device according to claim 1, characterized in that the thickness of the external layer (4), measured according to the RBS method, extends from 10 to 500 nanometers, and more preferably extends from 20 nanometers to 120 nanometers.

7. Device according to claim 1, characterized in that the thickness of the internal layer (3), measured according to the RBS method, extends from 20 nanometers to 50 nanometers.

8. Device according to claim 1, characterized in that it further comprises an intermediate layer (5) located between the metal support (2) and the internal layer (3) of the coating constituting a support that is catalytically inert with regard to oxidation selected among aluminum alloys, enamel, polytetrafluoroethylene and their mixtures.

9. Device according to claim 8, characterized in that the intermediate layer (5) located between the metal support (2) and the internal layer (3) of the coating is of enamel.

10. Device according to claim 1, characterized in that said device is in the shape of a pressing iron soleplate comprising an ironing surface and that the coating covers the ironing surface.

11. Device according to claim 1, characterized in that said device is in the shape of a cooking device comprising walls likely to come in contact with organic stains and the coating covers these walls.

12. Process for producing the heating device (1) of claim 1 said process comprising the following steps:

i) heating the surface of the metal support to be covered in an oven at around 400° C., ii) placing the surface of the metal support to be covered under infra-red at a temperature of 400° C. to 600° C. for a few seconds, iii) spraying a solution of an oxidation catalyst precursor chosen among oxides of the transition elements of Group 1*b* on the surface of the metal support to be covered to obtain the internal layer (3), iv) again heating the surface of the metal support to be covered, with the internal layer, in an oven at around 400° C., v) placing the surface of the metal support to be covered, with the internal layer, under infra-red at a temperature of 400° C. to 600° C. for a few seconds, vi) spraying a solution of an oxidation catalyst precursor chosen among oxides of platinoids on the internal layer to obtain the external layer (4), and vii) reheating the surface of the metal support covered with the internal and external layers under infra-red for a few minutes.

* * * * *